United States Patent [19]

Tseng

[11] Patent Number: 4,970,632

[45] Date of Patent: Nov. 13, 1990

[54] SOCKET AND BULB SNAP FASTENER FOR CHRISTMAS LIGHT STRINGS

[76] Inventor: Jeow N. Tseng, No. 539, Sec. 4, Chung Hua Rd., Hsin Chu City, Taiwan

[21] Appl. No.: 494,309

[22] Filed: Mar. 16, 1990

[51] Int. Cl.[5] ..... H01R 33/00

[52] U.S. Cl. ..... 362/226; 439/356; 439/619; 439/699

[58] Field of Search ..... 362/226, 800; 439/619, 439/699, 356, 360

[56] References Cited

U.S. PATENT DOCUMENTS 4,803,396 2/1989 Kelner ..... 439/356

*Primary Examiner*—Carroll B. Dority

*Attorney, Agent, or Firm*—Steinberg & Raskin

[57] ABSTRACT

A socket and bulb snap fastener for Christmas light strings includes at least one T-shaped tongue and a corresponding number of receiving means. The T-shaped tongue with a shoulder formed adjacent to a free end of the tongue is formed on an upper margin of a periphery of a socket of the bulb string for a Christmas tree. A V-shaped groove is formed on an upper side of each T-shaped tongue at an end opposite to the free end of the tongue and extends transversely across a length of each tongue. The receiving means is formed, corresponding to each T-shaped tongue, in the vicinity of an upper margin of an insert of the bulb string. The receiving means includes a compartment for receiving the tongue and a path through which the tongue is passable.

2 Claims, 3 Drawing Sheets

SOCKET AND BULB SNAP FASTENER FOR CHRISTMAS LIGHT STRINGS

BACKGROUND OF THE INVENTION

The present invention relates to a snap fastener and, in particular, to a socket and bulb snap fastener for Christmas light strings.

A conventional bulb and socket device in a light bulb string for a Christmas tree generally comprises a socket formed with a hole, a bulb consisting of a lighting element, and an insert including two leads which are mounted on either side of the insert and electrically connected to the lighting element.

Applicant's U.S. patent application No. 07/446,936 discloses a socket and bulb snap fastener for Christmas light strings comprising at least one T-shaped male member having a snapping head and a corresponding number of tongues designed so as to avoid problems commonly encountered during use of known Christmas light strings. The present invention provides a further improved design for a socket and bulb snap fastener for Christmas light strings.

SUMMARY OF THE INVENTION

According to one aspect of the present invention, a socket and bulb snap fastener for Christmas light strings comprises a socket and a bulb. The bulb comprises a lighting element and an insert having two leads mounted thereon which are electrically connected to the lighting element. A hole is centrally formed on the socket for receiving the insert. The insert and the socket of the present invention are identical with prior art. The features of the socket and bulb snap fastener according to the present invention constitute at least one substantially T-shaped tongue of insulating material formed on an upper margin of a periphery of the socket. Each T-shaped tongue has a shoulder formed adjacent to a free end of the T-shaped tongue. A V-shaped groove is formed on an upper side of each T-shaped tongue on an end opposite to the free end of the tongue and extends transversely across a length of each tongue.

A corresponding number of flexible receiving means of insulating material are formed, relative to each T-shaped tongue, in the vicinity of an upper margin of the insert. Each receiving means comprises two opposite L-shaped protrusions which together form a compartment and a path slightly less wide than a width of the T-shaped tongue. Each T-shaped tongue is engageable with each corresponding receiving means by bending the T-shaped tongue upwardly about the V-shaped groove and snapping each T-shaped tongue into the compartment via each corresponding path such that the shoulder of each T-shaped tongue abuts an upper surface of both protrusions.

According to another aspect of the present invention, the socket and bulb snap fastener according to the present invention is characterized in that at least one substantially T-shaped tongue of insulating material is formed in the vicinity of an upper margin of the insert. Each T-shaped tongue has a shoulder formed adjacent to a free end of the T-shaped tongue. A V-shaped groove is formed on a lower side of the T-shaped tongue at an end opposite to the free end of the tongue and extends transversely across a length of each tongue.

A corresponding number of flexible receiving means of insulating material are formed, relative to each T-shaped tongue, on an upper margin of a periphery of the socket. Each receiving means comprises two mirror image L-shaped protrusions which together form a compartment and a path slightly less wide than a width of the T-shaped tongue. Each T-shaped tongue is engageable with each corresponding receiving means by bending the T-shaped tongue downwardly about the V-shaped groove and snapping each T-shaped tongue into the compartment via each corresponding path such that the shoulder of each the T-shaped tongue abuts a lower surface of both protrusions.

It is therefore an object of the present invention to provide a snap fastener for a light bulb string for facilitating the engagement of the bulb in the socket.

It is another object of the present invention to provide a snap fastener which is interchangeable while retaining an equally effective securing function.

These and additional objects, if not set forth specifically herein, will be readily apparent to those skilled in the art from the detailed description provided hereinbelow, with appropriate reference to the accompanying drawings.

DETAILED DESCRIPTION OF THE PREFERRED EMBODIMENTS

Figure 1:
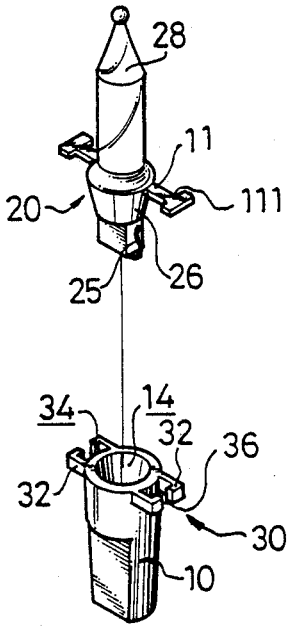
FIG. 1 is an exploded perspective view of a socket and bulb snap fastener for Christmas light strings in accordance with the present invention.
Figure 2:
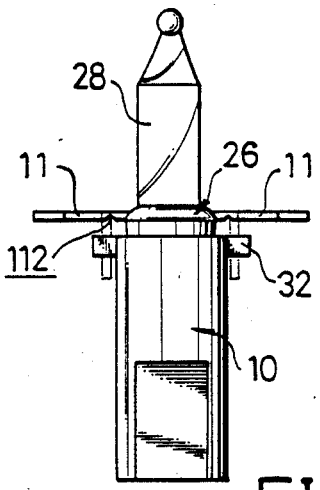
FIG. 2 is a side view of the socket and bulb snap fastener of FIG. 1 in accordance with the present invention showing the securing effect of the snap fastener.
Figure 3:
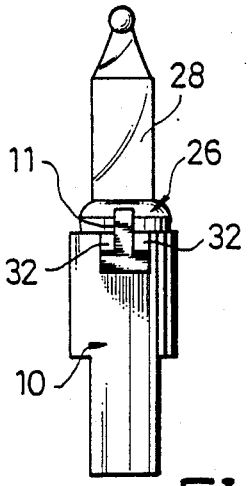
FIG. 3 is another side view of FIG. 2 showing the secured position.

Referring to FIGS. 1, 2 and 3, a socket and bulb snap fastener for Christmas trees comprises a socket 10 and a bulb 20. The bulb 20 comprises a lighting element 28 and an insert 26 having two leads 25 mounted thereon (only one lead is shown) which are electrically connected to the lighting element 28. A hole 14 is centrally formed on the socket 10 for receiving the insert 26.

Two T-shaped tongues 11 of insulating material each having a shoulder 111 are formed on diametrically opposed portions in the vicinity of an upper margin of the insert 26. A V-shaped groove 112 is formed on a lower side of the T-shaped tongue 11 at an end opposite to the free end of the tongue 11 and extends transversely across a length of each tongue 11 (see FIG. 4 for reference).

Two flexible receiving means 30 of insulating material are formed, relative to each T-shaped tongue 11, on an upper margin of a periphery of the socket 10. Each receiving means 30 comprises two opposite L-shaped protrusions 32 which together form a compartment 34 and a path 36 slightly less wide than a width of the T-shaped tongue 11. When engaging the insert 26 and the socket 10, the T-shaped tongue 11 is first bent downwardly about the V-shaped groove 112, and then each T-shaped tongue 11 is snapped into the compartment 34 via a corresponding path 36 such that the shoulder 111 of each T-shaped tongue 11 abuts a lower surface of both protrusions 32 as shown in FIGS. 2 and 3.

Figure 4:
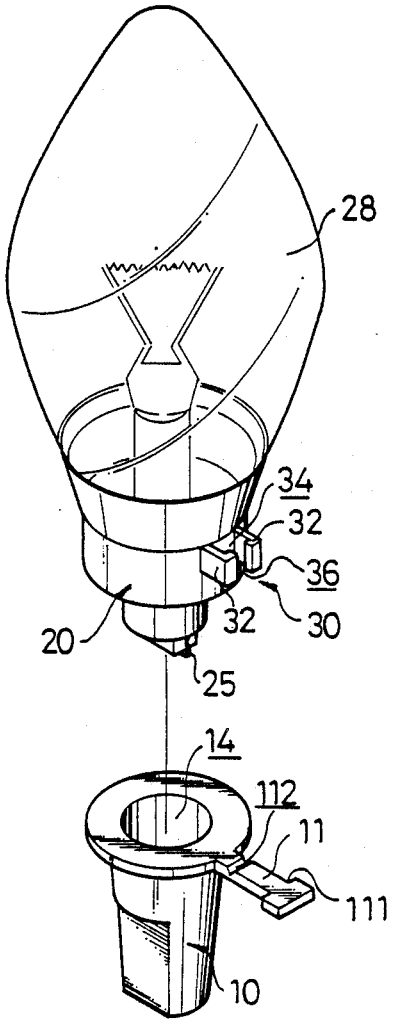
FIG. 4 is an exploded perspective view of another preferred embodiment of a socket and bulb snap fastener for Christmas light strings according to the present invention, wherein a single tongue and a receiving means are utilized.

Referring to FIG. 4, the socket and bulb snap fastener in accordance with the present invention can also be applied on a Christmas light string with large bulbs. The securing function of the snap fastener also can be achieved by the provision of a T-shaped tongue 11 on the socket 10 and a receiving means 30 on the insert 26.

As shown in FIG. 4, a T-shaped tongue 11 of insulating material is, alternatively, formed on an upper margin of a periphery of the socket 10. The T-shaped tongue 11 has a shoulder 111 formed adjacent to a free end of the T-shaped tongue 11. A V-shaped groove 112 is formed on an upper side of the T-shaped tongue 11 at an end opposite to the free end of the tongue 11 and extends transversely to a length of the tongue 11.

A flexible receiving means 30 of insulating material is formed, relative to the T-shaped tongue 11, in the vicinity of an upper margin of the insert 26. The receiving means 30 comprises two opposite L-shaped protrusions 32 which together form a compartment 34 and a path 36 slightly less wide than a width of the T-shaped tongue 11. The T-shaped tongue 11 is engageable with the receiving means 30 by bending the T-shaped tongue 11 upwardly about the V-shaped groove 112 and snapping the T-shaped tongue 11 into the compartment 34 via the path 36 such that the shoulder 111 of the T-shaped tongue 11 abuts an upper surface of both protrusions 32.

While the present invention has been explained in relation to its preferred embodiment, it is to be understood that various modifications thereof will be apparent to those skilled in the art upon reading this specification. Therefore, it is to be understood that the invention disclosed herein is intended to cover all such modifications as fall within the scope of the appended claims.

I claim:

1. A socket and bulb snap fastener for Christmas light strings, comprising a socket and a bulb, said bulb comprising a lighting element and an insert having two leads mounted thereon which are electrically connected to said lighting element, a hole being centrally formed on said socket for receiving said insert, the improvements further comprising:

at least one substantially T-shaped tongue of insulating material being formed on an upper margin of a periphery of said socket, each T-shaped tongue having a shoulder formed adjacent to a free end of said T-shaped tongue, a V-shaped groove being formed on an upper side of each said T-shaped tongue at an end opposite to said free end of said tongue and extending transversely across a length of each said tongue;

a corresponding number of flexible receiving means of insulating material being formed, relative to each said T-shaped tongue, in the vicinity of an upper margin of said insert, each receiving means comprising two mirror image L-shaped protrusions which together form a compartment and a path slightly less wide than a width of said T-shaped tongue, each said T-shaped tongue being engageable with each corresponding receiving means by bending said T-shaped tongue upwardly about said V-shaped groove and snapping each said T-shaped tongue into said compartment via a corresponding path such that said shoulder of each said T-shaped tongue abuts an upper surface of both said protrusions.

2. A socket and bulb snap fastener for Christmas light strings, comprising a socket and a bulb, said bulb comprising a lighting element and an insert having two leads mounted thereon which are electrically connected to said lighting element, a hole being centrally formed on said socket for receiving said insert, the improvements further comprising:

at least one substantially T-shaped tongue of insulating material being formed in the vicinity of an upper margin of said insert, each T-shaped tongue having a shoulder formed adjacent to a free end of said T-shaped tongue, a V-shaped groove being formed on a lower side of said T-shaped tongue at an end opposite to said free end of said tongue and extending transversely across a length of each said tongue;

a corresponding number of flexible receiving means of insulating material being formed, relative to each said T-shaped tongue, on an upper margin of a periphery of said socket, each receiving means comprising two mirror image L-shaped protrusions which together form a compartment and a path slightly less wide than a width of said T-shaped tongue, each said T-shaped tongue being engageable with each corresponding receiving means by bending said T-shaped tongue downwardly about said V-shaped groove and snapping each said T-shaped tongue into said compartment via a corresponding said path such that said shoulder of each said T-shaped tongue abuts a lower surface of both said protrusions.

* * * * *